US005518366A

United States Patent [19]

Gray

[11] Patent Number: 5,518,366

[45] Date of Patent: May 21, 1996

[54] EXHAUST SYSTEM FOR A TURBOMACHINE

[75] Inventor: Lewis Gray, Winter Springs, Fla.

[73] Assignee: Westinghouse Electric Corporation, Pittsburgh, Pa.

[21] Appl. No.: 259,096

[22] Filed: Jun. 13, 1994

[51] Int. Cl.[6] ..... F01D 25/30

[52] U.S. Cl. ..... 415/226; 415/225; 415/211.2

[58] Field of Search ..... 415/208.2, 211.2, 415/224.5, 225, 226

[56] References Cited

U.S. PATENT DOCUMENTS

| | | | |
|---|---|---|---|
| 3,058,720 | 10/1962 | Hart et al. | 253/76 |
| 3,149,470 | 10/1964 | Herzog | 60/64 |
| 3,690,786 | 10/1972 | Silvestri, Jr. | 415/121 |
| 3,697,191 | 10/1972 | Heymann | 415/168 |
| 3,945,760 | 3/1976 | Miller | 415/189 |
| 4,390,319 | 6/1983 | Garkusha et al. | 415/209 |
| 4,391,566 | 7/1983 | Takamura | 415/209 |
| 4,863,341 | 9/1989 | Groenendaal | 415/103 |
| 5,209,634 | 5/1993 | Owczarek | 415/208.2 |
| 5,257,906 | 11/1993 | Gray et al. | 415/226 |
| 5,340,276 | 8/1994 | Norris et al. | 415/211.2 |

FOREIGN PATENT DOCUMENTS

0418887A1 3/1991 European Pat. Off. .

*Primary Examiner*—F. Daniel Lopez
*Assistant Examiner*—Michael S. Lee
*Attorney, Agent, or Firm*—M. G. Panian

[57] ABSTRACT

An exhaust system for an axial flow turbomachine having a diffuser comprised of inner and outer flow guides that direct the flow of working fluid from a turbine cylinder to an exhaust housing having a bottom opening, thereby turning the flow 90° from the axial to radial direction. The flow exiting at the top of the diffuser is directed by a flow-guiding surface of the exhaust housing to turn 180° from the vertically upward direction to the downward direction. The axial length of the outer flow varies around the circumference thereof as a function of the distance from the flow-guiding surface of the exhaust housing to the inlet of the outer flow guide so that the axial length of the outer flow guide is less than 30% of the height of the last row blade airfoil throughout any portions of the outer flow guide in which the distance from the flow-guiding surface to the outer flow guide inlet is less than the height of the airfoil.

18 Claims, 5 Drawing Sheets

EXHAUST SYSTEM FOR A TURBOMACHINE

BACKGROUND OF THE INVENTION

The present invention relates to an exhaust system for a turbomachine, such as a steam or gas turbine or the like. More specifically, the present invention relates to an exhaust system for axial flow turbomachine in which the flow area of the exhaust housing is locally constricted.

The performance of a steam turbine may generally be improved by lowering the back pressure to which the last row of blades of the turbine is subjected. Consequently, turbines often discharge to a condenser in which a sub-atmospheric pressure is maintained. Typically, the exhaust steam discharging axially from the last row of blades is directed to a condenser mounted below the turbine by turning the flow 90° from the axial to the vertically downward directions. This turning of the flow is accomplished by an exhaust system that includes a diffuser in flow communication with an exhaust housing.

Diffusers are generally comprised of inner and outer flow guides that serve to increase the static pressure by reducing the velocity head. Typically, the cross-sectional shape of the outer flow guide is a simple arcuate shape—see, for example, U.S. Pat. Nos. 3,945,760; 4,863,341; 3,058,720; 3,697,191; and 3,690,786. However, conical shaped diffusers have also been utilized—see, for example, U.S. Pat. No. 4,391,566.

Although outer flow guides are generally of uniform axial length, outer flow guides have been proposed for use in bottom exhaust systems in which the axial length of the outer flow guide varies uniformly around its circumference, being a maximum at the bottom of the diffuser and a minimum at the top—see, U.S. Pat. No. 5,257,906 (Gray et al.), incorporated herein in its entirety by reference. Another outer flow guide that has been used in the past has a constant minimum axial length in the top half of the outer flow guide (that is, in the uppermost 180° of its circumference), a constant maximum length in the lowermost approximately 100° of its circumference, and transition regions at approximately 90°–130° and 230°–270° of its circumference in which the length increases from the minimum to the maximum.

Typically, the exhaust housing receives steam from the diffuser and directs it to the condenser through a bottom outlet opening in the housing. The steam from the diffuser enters the exhaust housing in a 360° arc. However, it discharges from the exhaust housing to the condenser through only the bottom outlet opening. This presents no problem with respect to the steam flowing in the bottom portion of the diffuser since by turning such steam into the radial direction, the diffuser turns the steam directly toward the bottom outlet opening. However, the steam discharging at the top of the diffuser must turn 180° from the vertically upward direction to the vertically downward direction, in addition to turning 90° from the axial direction to the vertically upward direction. As a result of this torturous flow path, losses are experienced by the steam flow that detract from the efficiency of the exhaust system and, therefore, the performance of the turbine.

The outer flow guide serves to minimize these losses by properly guiding the steam flow while turning it from the axial to the radial direction. It is generally thought that in order to properly guide the steam flow, the axial length of the outer flow guide should optimally be equal to at least approximately 50% of the height of the airfoil portions of the last row of blades.

Unfortunately, the inventor has found that in some turbine exhaust systems, especially those of older vintage, the flow area of the exhaust housing is locally constrained—that is, the space from the inlet of the outer flow guide to the exhaust housing is relatively small. As a result, the use of an outer flow guide of the "optimum" length results in insufficient flow area to allow the steam flow to smoothly turn 180° from vertically upward to vertically downward. Consequently, use of an "optimum" length outer flow guide does not result in the optimum thermodynamic performance.

It is therefore desirable to provide a high performance outer flow guide for an exhaust system that turns an axial flow discharging from a turbine into a radial direction, such as vertically downward, and in which the flow area of the exhaust housing is locally constricted.

SUMMARY OF THE INVENTION

Accordingly, it is the general object of the current invention to provide a high performance outer flow guide for an exhaust system that turns an axial flow discharging from a turbine into a radial direction, such as vertically downward, and in which the flow area of the exhaust housing is locally constricted.

Briefly, this object, as well as other objects of the current invention, is accomplished in a turbomachine comprising (i) a turbine cylinder enclosing a rotor and forming a flow path for a working fluid and having a row of rotating blades, the rotor defining an axis thereof, each of the blades having an airfoil portion having a tip portion and a base portion, the tip and base portions defining an airfoil length therebetween, (ii) an exhaust diffuser for directing the flow of the working fluid away from the turbine cylinder disposed proximate said row of rotating blades, the exhaust diffuser having inner and outer flow guides, the outer flow guide having an inlet and an outlet defining an axial length therebetween, the axial length varying circumferentially and being a minimum at a first circumferential location, and (iii) an exhaust housing having a surface forming a flow path for guiding the working fluid away from the exhaust diffuser, the flow-guiding surface spaced a distance from the outer flow guide inlet, the distance varying circumferentially around the outer flow guide and being a minimum proximate the first circumferential location.

In one embodiment of the invention, the minimum distance by which the flow-guiding surface is spaced from the outer flow guide inlet at the first circumferential location is less than the blade airfoil length and the minimum axial length of the outer flow guide is in the range of 5% to 20% of the blade airfoil length.

BRIEF DESCRIPTION OF THE DRAWINGS

FIG. 2(*b*) is an isometric view, partially cutaway, of the exhaust system shown in FIG. 2(*a*) showing a portion of the components therein.

DESCRIPTION OF THE PREFERRED EMBODIMENT

Figure 1:
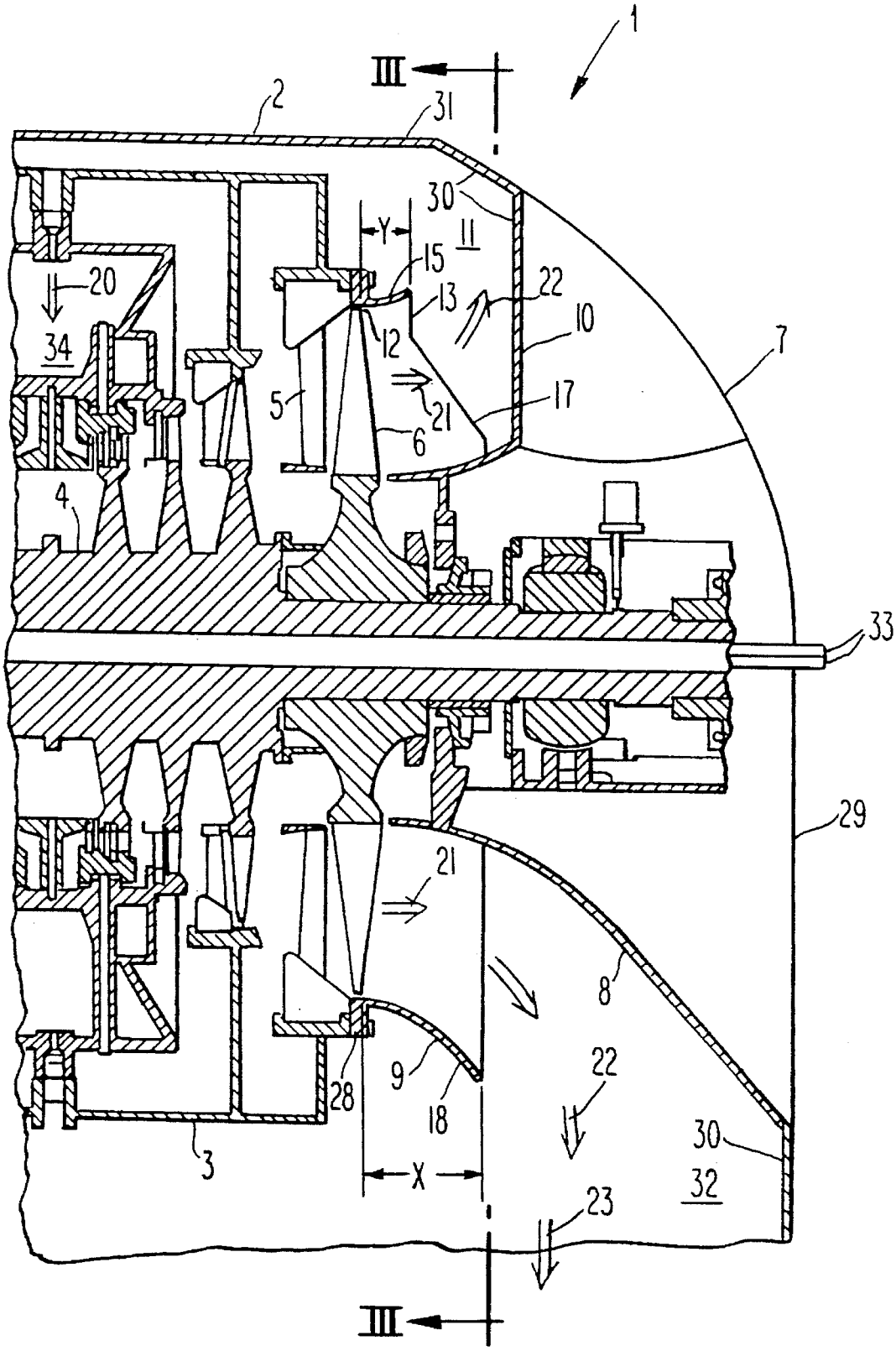
FIG. 1 is a longitudinal cross-section through a portion of a low pressure steam turbine incorporating the exhaust system according to the current invention.

There is shown in FIG. 1 a longitudinal cross-section through the right hand end of a double ended low pressure steam turbine in the vicinity of the exhaust system 1. The primary components of the steam turbine are an outer cylinder 2, an inner cylinder 3 enclosed by the outer cylinder, a centrally disposed rotor 4 enclosed by the inner cylinder and an exhaust system 1. The inner cylinder 3 and rotor 4 form an annular steam flow path therebetween, the inner cylinder forming the outer periphery of the flow path. A plurality of stationary vanes and rotating blades, each of which has an airfoil portion that is exposed to the steam flow 20, are arranged in alternating rows and extend into the steam flow path. The vanes are affixed to the inner cylinder 3 and the blades are affixed to the periphery of the rotor 4. The last row of stationary vanes are indicated by reference numeral 5 and the last row of rotating blades—that is, the downstream most row—are indicated by reference numeral 6. The flow path formed by the inner cylinder 3 terminates at the last row of blades 6.

Figure 5:
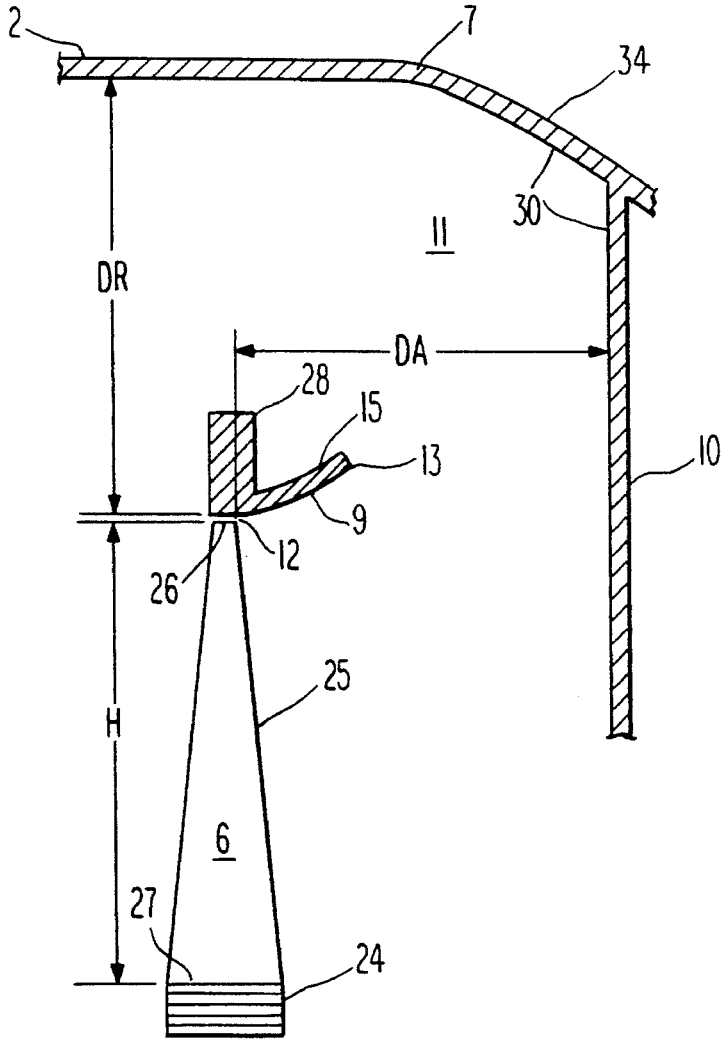
FIG. 5 is an enlarged view of a portion of FIG. 1 in the vicinity of top dead center.

As shown in FIG. 5, the last row blade 6 has an airfoil portion 25 and a root portion 24 by which it is affixed to the turbine rotor 4. The distal end of the airfoil 25 forms a tip portion 26. The proximal end of the airfoil adjacent the root 24 forms an airfoil base portion 27. The radial distance between the base and tip portions 27 and 26, respectively, define the length H of the airfoil 24. The length of the airfoil 25 is an important parameter in the design of the exhaust system, as discussed further below.

Figure 2A:
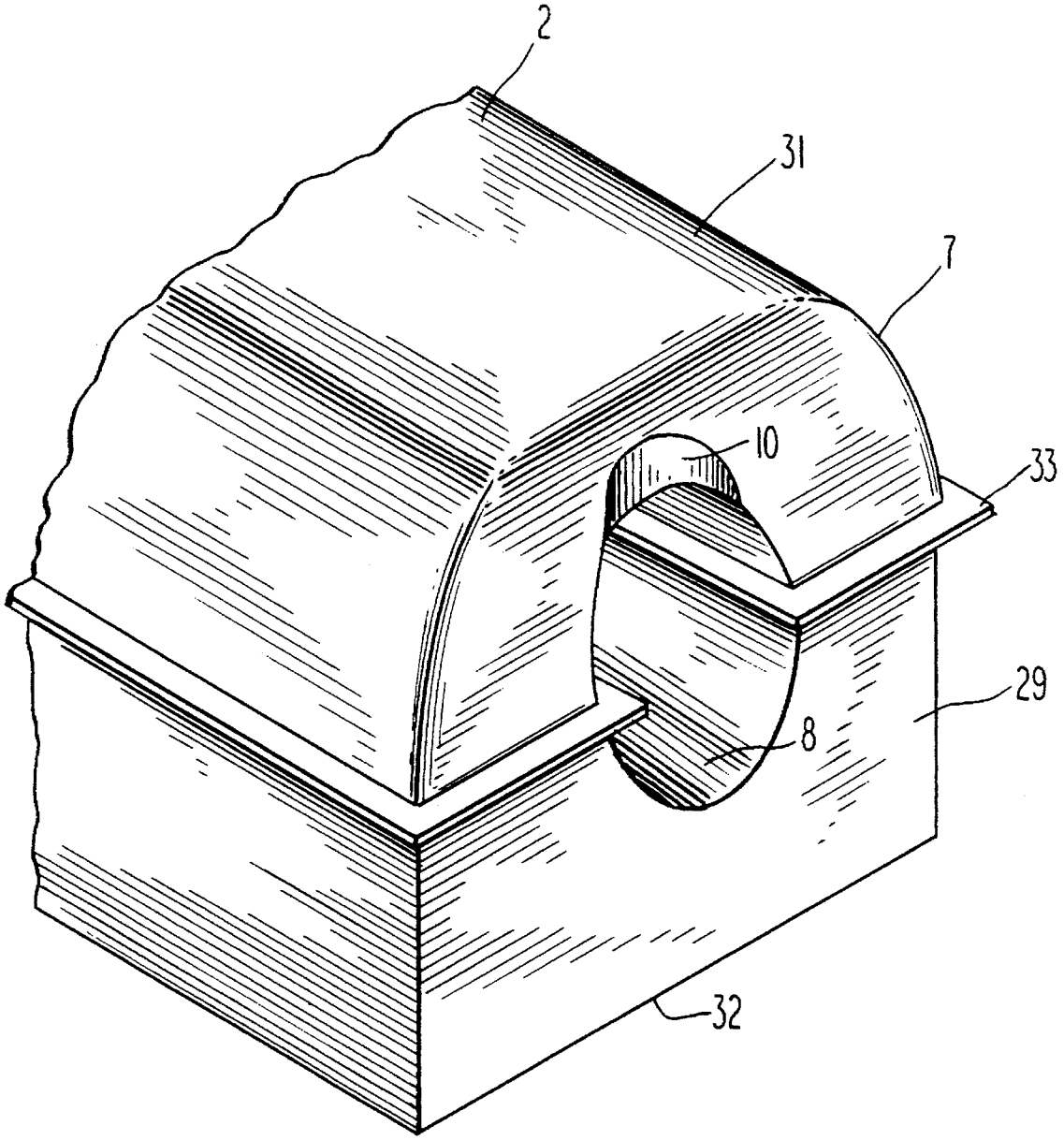
FIG. 2(*a*) is an isometric view the exterior of the exhaust system shown in FIG. 2.
Figure 2B:
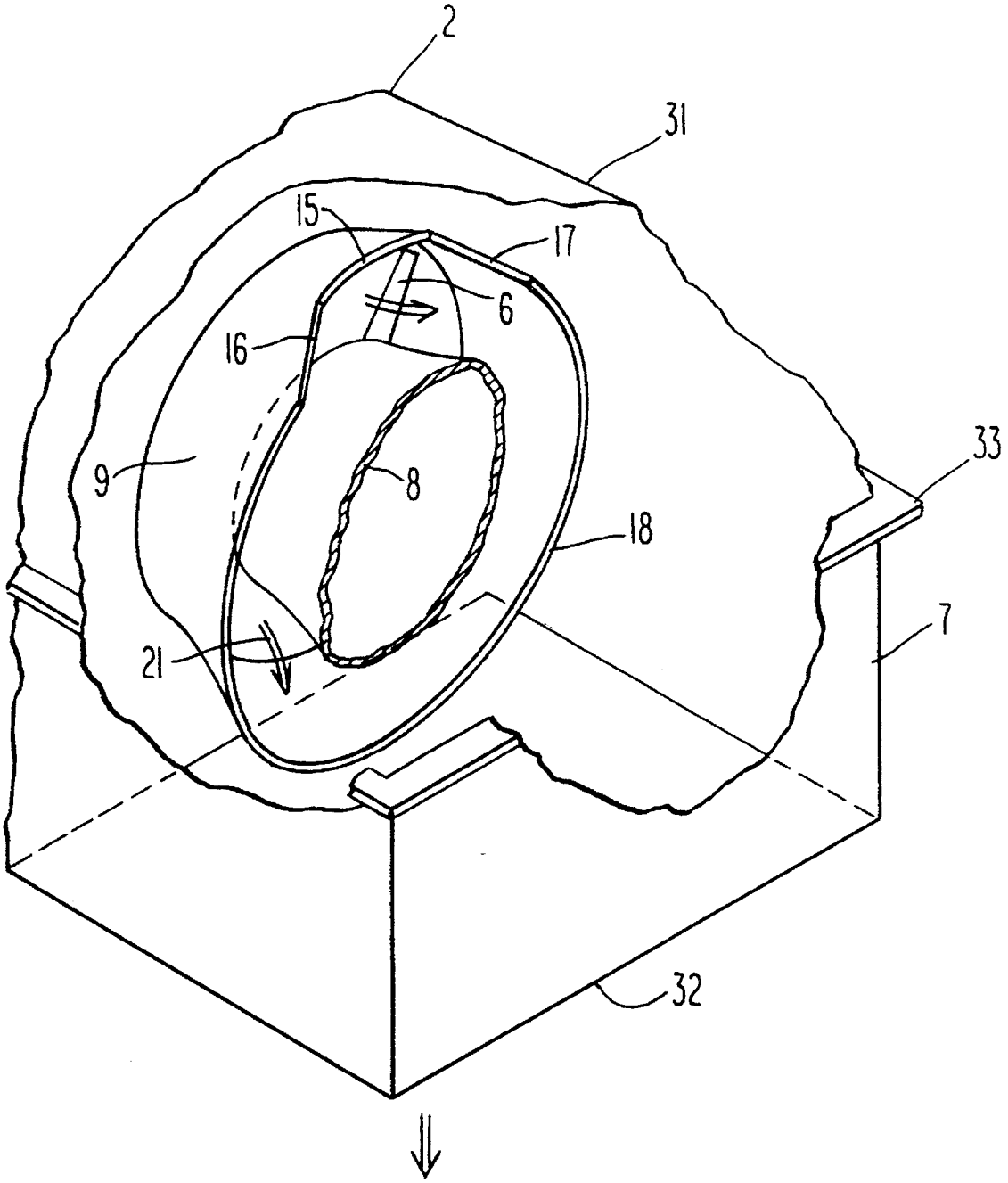
Figure 3:
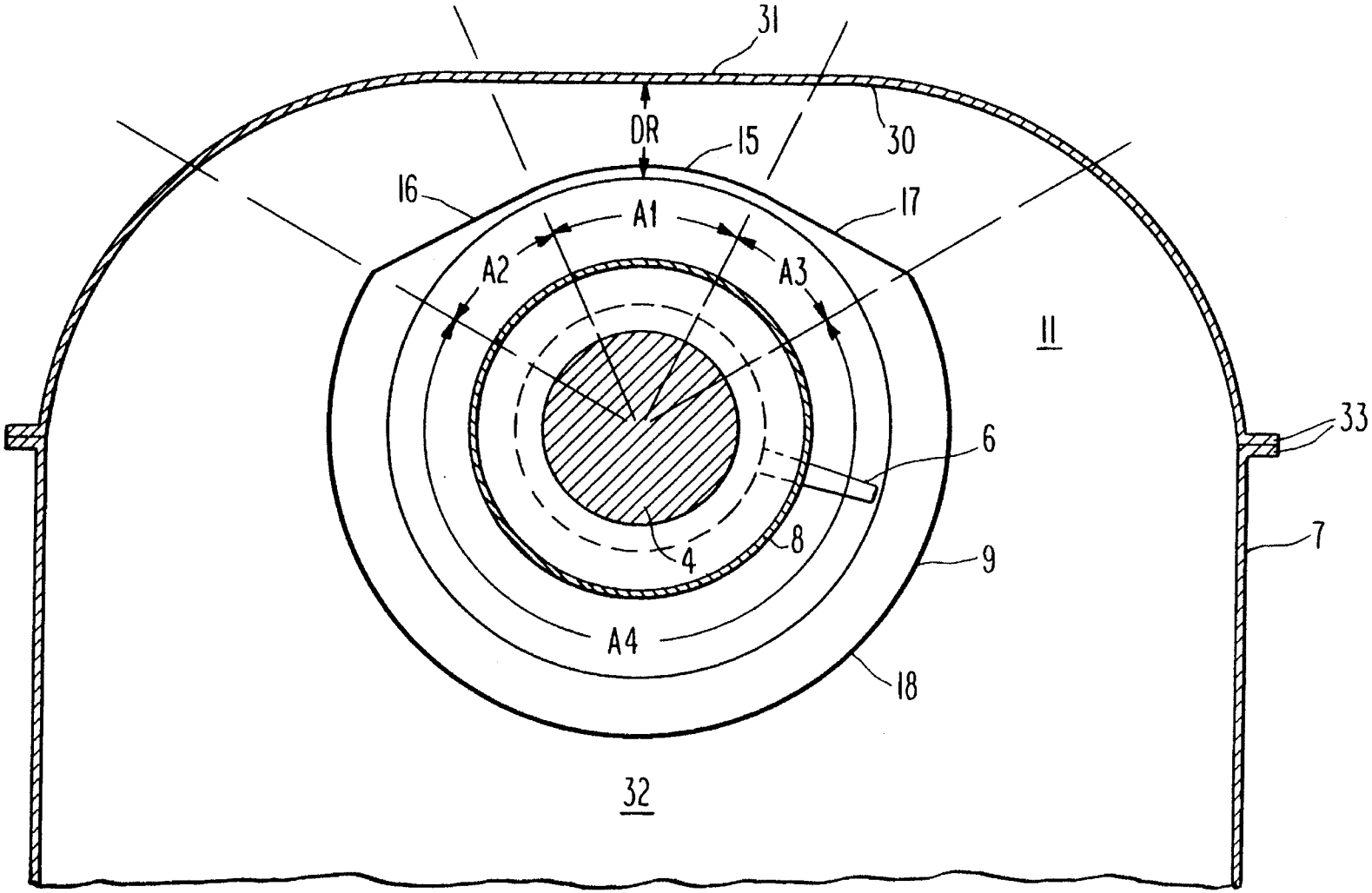
FIG. 3 is a transverse cross-section taken through line III—III shown in FIG. 1.

As shown in FIGS. 1–3, the exhaust system 1 is comprised of an exhaust housing 7 that extends from the turbine outer cylinder 2. Upper and lower portions of the exhaust housing 7 are joined along horizontal flanges 33. The exhaust housing 7 is formed by an end wall 29 that is connected to a rim 31. The end wall 29 extends vertically below the flanges 33 but curves toward the turbine cylinder 2 above the flanges. The rim 31 has the approximate shape of an inverted U. An outlet 32 is formed in the bottom of the exhaust housing 7 and is connected to a condenser (not shown).

An exhaust diffuser is disposed within the exhaust housing 7. The exhaust diffuser is formed by inner and outer flow guides 8 and 9, respectively. The inner and outer flow guides 8 and 9 form an approximately annular diffusing passage therebetween. The outer flow guide 9 is attached to the inner cylinder 3 via a flange 28. As shown best in FIG. 5, the flange 28 has an inner surface that encircles the tips 26 of the last row of blades 6. The portion of this inner surface immediately downstream from the blade tips 26 forms the inlet 12 of the outer flow guide 9. An edge 13 forms the outlet of the outer flow guide 9. The distance in the axial direction between the inlet 12 and the outlet edge 13 of the outer flow guide 9 define its axial length.

As shown in FIGS. 1–3, the exhaust housing 7 has a surface 30 that, in conjunction with the inner and outer flow guides 8 and 9, respectively, forms an approximately horseshoe-shaped chamber 11. In the embodiment shown in FIG. 1, the surface 30 is formed by the inner surface of the rim 31 and the end wall 29.

As shown in FIG. 1, steam 20 enters the steam turbine 1 from an annular chamber in the outer cylinder 2. The steam flow is then split into two streams, each flowing axially outward from the center of the steam turbine through the aforementioned steam flow path, thereby imparting energy to the rotating blades. The steam 21 discharges axially from the last row of blades 6 and enters the exhaust diffuser. The exhaust diffuser guides the steam 21 into the exhaust housing 7 over a 360° arc. Due to the curvature of its surfaces, the diffuser turns the steam 21 approximately 90° into a substantially radial flow of steam 22 entering the chamber 11. The flow-guiding surface 30 in chamber 11 directs the steam 22 to the exhaust housing outlet 32.

As previously discussed, it has been found that the losses associated with turning the steam 21 through an angle of 90° in the diffuser can be minimized by using an outer flow guide having an axial length—that is, the distance in the axial direction between the inlet 12 and the outlet edge 13 of the outer flow guide—that is, equal to at least 50% of the height H of the airfoil 24 of the last row blades 6.

As shown in FIG. 3, at the bottom of the chamber 11 the radially flowing steam 22 exiting the diffuser merely continues to flow radially downward through the outlet 32. However, at the top of the chamber 11—that is, at the apex of the horseshoe shape—the steam 22 is discharged in the vertically upward direction by the exhaust diffuser and must turn an additional 180° around the horseshoe-shape to flow vertically downward to the opening 32. The steam flow 22 is guided in this 180° turn by the flow-guiding surface 30 of the exhaust housing 7. This large and relatively abrupt change in steam flow direction at the top of the chamber 11 tends to create vortices and losses in the steam flow that detract from the performance of the steam turbine.

Figure 4:
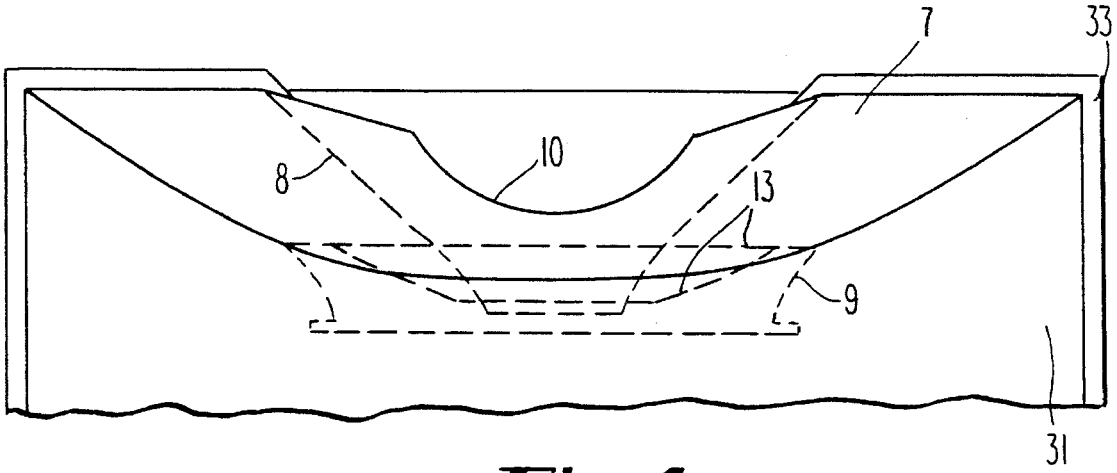
FIG. 4 is a top view of the exhaust system shown in FIG. 1.

The losses associated with the turning of the steam flow are exacerbated in some turbines, especially those of older vintage, in which the flow area of the chamber is constricted in certain locations. The current invention is concerned with such a constricted flow area exhaust system. As shown in FIG. 3, typically, in such exhaust systems, the top half of the rim 31 is typically somewhat flattened, having an approximately half-oval shape. In addition, as shown in FIGS. 1 and 4, a semi-circular radially extending portion 10 of the end wall 9, which facilitates access to the rotor bearing, projects from a portion of the top half of the inner flow guide 8. Consequently, the distance from the inlet 12 of the outer flow guide 9 to the flow-guiding surface 30 of the exhaust housing 7 is considerably less at the top of the outer flow guide than at the bottom.

As a result of this situation, the flow area of the upper portion of the chamber 11, in which the steam flow 22 is guided by the surface 30 to make a 180° turn, would be insufficient to properly direct the flow of steam 22 to the exhaust housing outlet 32 if a full length outer flow guide 9—that is, a flow guide having an axial length of at least 50% of the airfoil height H—were used. As a result, in such constricted area exhaust housings, the use of full length outer flow guide would not minimize the losses experienced by the steam flow, and might even exacerbate such losses.

According to the current invention, this problem is solved by utilizing an outer flow guide having an axial length compatible with the flow area constraints associated with an exhaust system of the type discussed above. Specifically, the inventor has found that an outer flow guide axial length in excess of 50% of the height H of the last row blade airfoil 25 can be used in any portions of the outer flow guide located in areas in which the distance from the inlet 12 of the outer flow guide 9 to the flow-guiding surface 30 of the exhaust housing 7 is at least as great as the height H of the airfoil 24 of the last row blades 6. However, for any portions of the outer flow guide 9 located in areas where the distance from the outer flow guide inlet 12 to the flow-guiding surface 30 of the exhaust housing 7 is less than the airfoil height H, the axial length of the outer flow guide should be no greater than 30% of the airfoil height H, and, preferably, in the range of approximately 5% to 20% of the airfoil height. Consequently, for exhaust systems with locally constricted flow area regions, the axial length of the outer flow guide should be varied around its circumference, as shown in FIGS. 1–4.

In the embodiment of the invention shown in FIG. 5, both the radial distance DR and the axial distance DA from the outer flow guide inlet 12 at top dead center to the flow-guiding surface 30 are less than the height H of the last row blade airfoil 25. As shown in encompasses an angle of 60° relative to the axis defined by the rotation of the rotor 4 (in the preferred embodiment, the outer flow guide 9 is symmetric about the vertical center line so that the sector A1 extends 30° in both the clockwise and counter-clockwise directions from top dead center). Consequently, within the portion 15 of the outer flow guide 9 that is located in sector A1, its axial length, indicated by Y in FIG. 1, is less than 30% of the height H of the last row blade airfoil 25, and, preferably, is between 5% and 20% of the airfoil height, most preferably, approximately 5%. As shown in FIG. 3, in the preferred embodiment, the axial length throughout portion 15 is a constant and equal to approximately 5% of the airfoil height H.

By contrast, in portion 18 of the outer flow guide 9, which is located in a sector A4 that encompasses an angle of approximately 240° in the lower portion of the outer flow guide, the distance from the outer flow guide inlet 12 to the flow-guiding surface 30 of the exhaust system 7 is greater than the height H of the last row blade airfoil 25. Accordingly, the axial length, indicated by X in FIG. 1, of portion 18 of the outer flow guide 9 is greater than 50% of the airfoil height H. In the preferred embodiment, the axial length is a constant throughout portion 18 and is equal to approximately 65% of the airfoil height H.

In portions 16 and 17 of the outer flow guide 9, which are located in sectors A2 and A3 that each encompass an angle of approximately 30° between portions 15 and 18, the distance from the outer flow guide inlet 12 to the flow-guiding surface 30 of the exhaust system 7 is greater than the height H of the last row blade airfoil 25. Although there is sufficient flow area in these sectors to allow the use of a flow guide axial length of at least 50% of the airfoil H, preferably the length of the outer flow guide increases linearly with angular location in these portions so as to form a smooth transition between the minimum length portion 15 and the maximum length portion 18.

Thus, the axial length of the outer flow guide 9 varies circumferentially around its circumference as a function of the distance from the outer flow guide inlet 12 to the flow-guiding surface 30 of the exhaust housing 7.

Although the current invention has been described with reference to a bottom exhaust low pressure steam turbine, the invention is equally applicable to side or top exhaust steam turbines. In addition, the invention is equally applicable to other axial flow devices, such as gas turbines, fans and compressors. Accordingly, the present invention may be embodied in other specific forms without departing from the spirit or essential attributes thereof and, accordingly, reference should be made to the appended claims, rather than to the foregoing specification, as indicating the scope of the invention.

I claim:

1. A turbomachine, comprising a) a turbine cylinder enclosing a rotor and forming a flow path for a working fluid, said rotor defining an axis thereof and having a row of rotating blades, each of said blades having an airfoil portion having a tip portion and a base portion, said tip and base portions defining an airfoil length therebetween;

b) an exhaust diffuser for directing the flow of said working fluid away from said turbine cylinder disposed proximate said row of blades, said exhaust diffuser having inner and outer flow guides, said outer flow guide having an inlet and an outlet defining an axial length therebetween, said axial length varying circumferentially and being a minimum at a first circumferential location; and c) an exhaust housing having a surface forming a flow path for guiding said working fluid away from said exhaust diffuser, said flow-guiding surface spaced a distance from said outer flow guide inlet, said distance varying circumferentially around said outer flow guide and being a minimum proximate said first circumferential location, wherein said distance by which said flow-guiding surface is spaced from said outer flow guide inlet is less than said blade airfoil length throughout a first circumferential sector, said first circumferential location being disposed within said first circumferential sector.

2. The turbomachine according to claim 1, wherein said minimum axial length of said outer flow guide is no greater than 30% of said blade airfoil length.

3. The turbomachine according to claim 2, wherein said minimum axial length of said outer flow guide is in the range of 5% to 20% of said blade airfoil length.

4. The turbomachine according to claim 1, wherein said axial length of said outer flow guide is in the range of 5% to 20% of said blade airfoil length throughout said first circumferential sector.

5. The turbomachine according to claim 4, wherein said first circumferential sector encompasses an angle of at least 60° with respect to said rotor axis.

6. The turbomachine according to claim 1, wherein said axial length of said outer flow guide is at least 50% of said blade airfoil length at a second circumferential location being disposed outside of said first circumferential sector.

7. The turbomachine according to claim 6, wherein said distance by which said flow-guiding surface is spaced from said outer flow guide inlet is greater than said blade airfoil length at said second circumferential location.

8. The turbomachine according to claim 7, wherein said distance by which said flow-guiding surface is spaced from said outer flow guide inlet is greater than said blade airfoil length over a second circumferential sector, said second circumferential location being disposed within said second circumferential sector.

9. The turbomachine according to claim 8, wherein said axial length of said outer flow guide is equal to at least 50% of said blade airfoil length throughout said second circumferential sector.

10. The turbomachine according to claim 9, wherein said second circumferential sector encompasses an angle of at least 240° with respect to said rotor axis.

11. The turbomachine according to claim 8, wherein said axial length of said outer flow guide varies over a portion of said outer flow guide between said first and second sectors.

12. The turbomachine according to claim 11, wherein said axial length of said outer flow guide varies approximately linearly over said portion of said outer flow guide between said first and second sectors.

13. The turbomachine according to claim 1, wherein said flow-guiding surface includes an approximately "U" shaped portion.

14. The turbomachine according to claim 1, wherein said flow path formed by said cylinder discharges said working fluid in a substantially axial direction, said diffuser having means for turning said working fluid into a plurality of substantially radial directions, and wherein said flow-guiding surface has means for directing said working fluid to flow in only one of said radial directions.

15. A turbomachine, comprising:

a) a turbine cylinder enclosing a row of rotating blade airfoils and forming a flow path terminating proximate said row of blade airfoils, said flow path having means for discharging a working fluid in a substantially axial direction, each of said blade airfoils having a radial length;

b) a flow guide disposed so as to receive said working fluid from said cylinder and having means for turning said working fluid approximately 90° from said axial direction, whereby said working fluid flows radially outward, said flow guide having an inlet and an outlet defining an axial length therebetween, said flow guide axial length being no more than approximately 30% of said airfoil radial length over a first portion of said flow guide and greater than approximately 50% of said airfoil radial length over a second portion of said flow guide; and c) an exhaust housing having (i) means for receiving said working fluid from said flow guide and (ii) a flow-guiding surface having means for turning at least a portion of said working fluid 180°, said flow-guiding surface being spaced from said flow guide inlet over said first portion of flow guide by a distance less than said airfoil radial length and being spaced from said flow guide inlet over said second portion of flow guide by a distance greater than said airfoil radial length.

16. The turbomachine according to claim 15, wherein said flow guide axial length is in the range of approximately 5% to 20% of said airfoil radial length over said first portion of said flow guide.

17. The turbomachine according to claim 15, wherein said flow guide axial length varies as a function of said distance by which said flow-guiding surface is spaced from said inlet of said flow guide.

18. A turbomachine, comprising:

a) a turbine cylinder enclosing a row of rotating blade airfoils and forming a flow path terminating proximate said blade row, said flow path having means for discharging a working fluid in a substantially axial direction, each of said blade airfoils having a radial length;

b) a flow guide disposed so as to receive said working fluid from said cylinder and having means for turning said working fluid approximately 90° from said axial direction, whereby said working fluid flows radially outward, said flow guide having an inlet and an outlet defining an axial length therebetween, said flow guide outlet having a circumference, said axial length of said flow guide varying around said circumference; and c) an exhaust housing having (i) means for receiving said working fluid from said flow guide and (ii) a flow-guiding surface having means for turning at least a portion of said working fluid 180°, said flow-guiding surface being spaced from said flow guide inlet by an amount that varies circumferentially around said flow guide, said axial length of said flow guide varying as a function of said amount by which said flow-guiding surface is spaced from said flow guide inlet.

* * * * *